US010724735B2

(12) United States Patent
Cowan et al.

(10) Patent No.: US 10,724,735 B2
(45) Date of Patent: Jul. 28, 2020

(54) METHOD AND APPARATUS FOR DISTRIBUTING HEAT FROM A BURNER

(71) Applicant: Midea Group Co., Ltd., Beijiao, Shunde, Foshan (CN)

(72) Inventors: Richard W. Cowan, Louisville, KY (US); Mark W. Wilson, Simpsonville, KY (US); Vern Neal, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 259 days.

(21) Appl. No.: 15/842,119

(22) Filed: Dec. 14, 2017

(65) Prior Publication Data

US 2019/0186734 A1 Jun. 20, 2019

(51) Int. Cl.

| | |
|---|---|
| ***F24C 3/08*** | (2006.01) |
| ***F23D 14/84*** | (2006.01) |
| ***F23D 14/06*** | (2006.01) |

(52) U.S. Cl.

CPC ..... *F23D 14/84* (2013.01); *F23D 14/06* (2013.01); *F23D 2900/14005* (2013.01); *F23D 2900/14061* (2013.01)

(58) Field of Classification Search

CPC ..... F24C 15/107; F24C 3/082; F24C 3/085; F23D 14/06; F23D 14/84

USPC ..... 431/266; 126/39 R, 41 B, 41 A, 39 E, 126/39 I

See application file for complete search history.

(56) References Cited

U.S. PATENT DOCUMENTS

| | | | | |
|---|---|---|---|---|
| 557,344 | A | 3/1896 | Shaw | |
| 1,158,475 | A | 11/1915 | Fox | |
| 1,163,807 | A | 12/1915 | Bower | |
| 1,870,476 | A | 8/1932 | Babcock | |
| 20,616,375 | | 11/1936 | Schulz | |
| 2,155,425 | A | 4/1939 | Mere | |
| 2,327,512 | A * | 8/1943 | Dennis | F23D 14/00 239/226 |
| 2,491,324 | A * | 12/1949 | Maki | F23D 11/04 239/132.5 |
| 2,542,265 | A | 2/1951 | Staples | |
| 2,591,072 | A | 4/1952 | Hughes | |

(Continued)

FOREIGN PATENT DOCUMENTS

| | | |
|---|---|---|
| CN | 2070880 | 2/1991 |
| CN | 200968636 | 10/2007 |

(Continued)

OTHER PUBLICATIONS

International Search Report and Written Opinion issued in Application No. PCT/CN2018/074253 dated Aug. 3, 2018.

(Continued)

*Primary Examiner* — Grant Moubry
*Assistant Examiner* — Rabeeul I Zuberi
(74) *Attorney, Agent, or Firm* — Middleton Reutlinger

(57) ABSTRACT

A method and apparatus for a gas burner head with one or more rotating burners. The gas burner head may include an outer burner and an inner burner rotating about an axis. Multiple gas burner heads may be rotatably interconnected. Rotating one or more burners within one or more gas burner heads may allow a variety of burner characteristics and/or patterns. One or more gas burner heads may be used in a variety of applications.

30 Claims, 5 Drawing Sheets

(56) References Cited

U.S. PATENT DOCUMENTS

| | | | | |
|---|---|---|---|---|
| 2,646,788 | A * | 7/1953 | Locke | F23D 14/04 126/39 H |
| 3,220,457 | A | 11/1965 | Bailey | |
| 3,233,079 | A | 2/1966 | Wunderlin | |
| 4,034,200 | A | 7/1977 | Visagie | |
| 4,547,146 | A | 10/1985 | Tanaka et al. | |
| 4,808,781 | A | 2/1989 | Liu | |
| 4,938,687 | A | 7/1990 | Monteil | |
| 5,059,755 | A * | 10/1991 | Nottingham | H05B 6/6411 108/20 |
| 5,077,460 | A | 12/1991 | Roche et al. | |
| 5,325,619 | A | 7/1994 | Paul | |
| 5,740,789 | A | 4/1998 | Chang | |
| 6,017,211 | A | 1/2000 | Gort et al. | |
| 6,107,615 | A | 8/2000 | Choi | |
| 6,325,619 | B2 | 12/2001 | Dane | |
| RE39,687 | E | 6/2007 | Choi | |
| 7,655,884 | B2 | 2/2010 | Engelhardt | |
| 10,082,295 | B2 | 9/2018 | Zanetti et al. | |
| 10,228,144 | B2 | 3/2019 | Johncock et al. | |
| 10,281,145 | B2 | 5/2019 | Yang | |
| 2014/0231413 | A1* | 8/2014 | Zanetti | F24C 15/103 219/621 |
| 2016/0334109 | A1 | 11/2016 | Krohn | |
| 2016/0348917 | A1 | 12/2016 | Johncock et al. | |
| 2017/0108215 | A1 | 4/2017 | Yang | |
| 2017/0108226 | A1 | 4/2017 | Moon et al. | |
| 2018/0106476 | A1 | 4/2018 | Breccia et al. | |
| 2019/0056115 | A1 | 2/2019 | Cadima | |
| 2019/0120496 | A1 | 4/2019 | Paller | |
| 2019/0154265 | A1 | 5/2019 | Johncock et al. | |

FOREIGN PATENT DOCUMENTS

| | | | |
|---|---|---|---|
| CN | 103175212 | A | 6/2013 |
| DE | 515602 | | 1/1931 |
| EP | 1725811 | | 11/2006 |
| EP | 1725811 | B1 | 11/2006 |
| EP | 2857752 | A1 | 4/2015 |
| FR | 2449220 | | 8/1982 |
| FR | 2499220 | B1 | 6/1985 |
| GB | 776349 | A | 6/1957 |
| IN | 02717CH2013 | | 6/2016 |
| JP | 09229368 | A | 9/1997 |
| TW | 201038887 | A1 | 11/2010 |
| WO | 2014195067 | A1 | 12/2014 |
| WO | 2015054981 | A1 | 4/2015 |

OTHER PUBLICATIONS

International Search Report and Written Opinion issued in Application No. PCT/CN2018/074175 dated Jul. 5, 2018.

U.S. Patent and Trademark Office, Non-Final Office Action issued in related U.S. Appl. No. 15/841,456 dated Sep. 20, 2019.

Citation of Related U.S. Patents and/or Applications dated Mar. 2, 2018.

U.S. Patent and Trademark Office, Notice of Allowance issued in U.S. Appl. No. 15/841,456 dated Apr. 30, 2020.

* cited by examiner

METHOD AND APPARATUS FOR DISTRIBUTING HEAT FROM A BURNER

CROSS-REFERENCE TO RELATED APPLICATION

This application is related to the following application, which is filed on even date herewith and assigned to the same assignee as the present application: U.S. patent application Ser. No. 15/841,456 entitled "METHOD AND APPARATUS FOR DISTRIBUTING HEAT FROM A BURNER." The disclosure of this application is incorporated by reference herein.

BACKGROUND

The present embodiments relate to a method and apparatus for a gas range integrated into a cooking appliance.

Typical gas burner heads are fixed in position on a cooktop surface and do not rotate (e.g. stationary). However, this practice of using a fixed gas burner head may concentrate the flame exiting the one or more flame ports and create uneven heating beneath the cooking utensil (e.g. pan, pot, etc.). Thus, there is a need to evenly distribute heat from a rotating gas burner head. Moreover, aesthetics of the one or more rotating burners and/or flames exiting the burner ports may be improved over fixed gas burner heads.

SUMMARY

In some embodiments, a gas range appliance may comprise a first gas burner head having at least a first burner with a plurality of first burner ports. In various embodiments, the plurality of first burner ports may be in fluid communication with one or more upstream gas flow channels. In addition, in some embodiments, the first gas burner head may include a first plurality of gear teeth and may rotate about a first central axis. In various embodiments, a second gas burner head may have at least a second burner with a plurality of second burner ports. In some embodiments, the plurality of first burner ports may be in fluid communication with one or more upstream gas flow channels. In various embodiments, the second gas burner head may include a second plurality of gear teeth and may rotate about a second central axis. In some embodiments, the gas range appliance may include at least one drive gear. Moreover, in various embodiments, the gas range appliance may include a first idler gear positionable in an engaged position and a disengaged position. In some embodiments, when in the engaged position the first idler gear may engage at least one drive gear with the first plurality of gear teeth of the first gas burner head and when in the disengaged position the first idler gear may disengage at least one drive gear from the first plurality of gear teeth of the first gas burner head. In various embodiments, the gas range appliance may include a second idler gear positionable in an engaged position and a disengaged position. In some embodiments, when in the engaged position the second idler gear may engage at least one drive gear with the second plurality of gear teeth of the second gas burner head and when in the disengaged position the second idler gear may disengage at least one drive gear from the second plurality of gear teeth of the second gas burner head.

In addition, in some embodiments, the gas range appliance may further comprise a motor rotating at least one drive gear. In various embodiments, the gas range appliance may include a single motor. Moreover, in some embodiments, the gas range appliance may further comprise a first solenoid positioning the first idler gear in at least one of the engaged position and the disengaged position. In various embodiments, the gas range appliance may further comprise a second solenoid positioning the second idler gear in at least one of the engaged position and the disengaged position. In some embodiments, the first idler gear may be in the engaged position and the second idler gear may be in the disengaged position. In addition, in some embodiments, the first idler gear may be in the disengaged position and the second idler gear may be in the disengaged position. In some embodiments, the first gas burner head may include a third burner, wherein the first burner may rotate about the first central axis in a first rotational direction, and wherein the third burner may rotate about a third central axis in a second rotational direction. In various embodiments, the first rotational direction may be different from the second rotational direction. In some embodiments, the first central axis may be coaxially aligned with the third central axis.

In some embodiments, a gas range may comprise a first gas burner head having at least a first burner with a plurality of first burner ports. In various embodiments, the plurality of first burner ports may be in fluid communication with one or more upstream gas flow channels. In some embodiments, the first gas burner head may include a first plurality of gear teeth and may rotate about a first central axis. In addition, in some embodiments, a second gas burner head having at least a second burner with a plurality of second burner ports. In various embodiments, the plurality of first burner ports may be in fluid communication with one or more upstream gas flow channels. In addition, in some embodiments, the second gas burner head may include a second plurality of gear teeth and may rotate about a second central axis. In some embodiments, the gas range may include a single motor and at least one drive gear. In various embodiments, the gas range may include a first idler gear positionable in an engaged position and a disengaged position, wherein when in the engaged position the first idler gear may engage at least one drive gear with the first plurality of gear teeth of the first gas burner head and when in the disengaged position the first idler gear may disengage at least one drive gear from the first plurality of gear teeth of the first gas burner head. Moreover, in some embodiments, the gas range may include a second idler gear positionable in an engaged position and a disengaged position, wherein when in the engaged position the second idler gear may engage at least one drive gear with the second plurality of gear teeth of the second gas burner head and when in the disengaged position the second idler gear may disengage at least one drive gear from the second plurality of gear teeth of the second gas burner head.

In addition, in some embodiments, the gas range may be in combination with an appliance. In various embodiments, the first gas burner head may include a third burner, wherein the first burner may rotate about the first central axis in a first rotational direction, and wherein the third burner may rotate about a third central axis in a second rotational direction. In some embodiments, the first central axis may be coaxially aligned with the third central axis. Moreover, in some embodiments, the first rotational direction may be different from the second rotational direction.

In some embodiments, a method of distributing heat from a gas range may comprise the step of providing a first gas burner head having at least a first burner with plurality of first burner ports, wherein the plurality of first burner ports may be in fluid communication with one or more upstream gas flow channels, and wherein the first gas burner head may include a first plurality of gear teeth and may rotate about a first central axis. In various embodiments, the method may include providing a second gas burner head having at least a second burner with a plurality of second burner ports, wherein the plurality of first burner ports may be in fluid communication with one or more upstream gas flow channels, and wherein the second gas burner head may include a second plurality of gear teeth and may rotate about a second central axis. In some embodiments, the method may include providing at least one drive gear. In addition, in various embodiments, the method may include positioning a first idler gear between an engaged position and a disengaged position, wherein when in the engaged position the first idler gear may engage at least one drive gear with the first plurality of gear teeth of the first gas burner head and when in the disengaged position the first idler gear may disengage at least one drive gear from the first plurality of gear teeth of the first gas burner head. In various embodiments, the method may include positioning a second idler gear between an engaged position and a disengaged position, wherein when in the engaged position the second idler gear may engage at least one drive gear with the second plurality of gear teeth of the second gas burner head and when in the disengaged position the second idler gear may disengage at least one drive gear from the second plurality of gear teeth of the second gas burner head. In some embodiments, the method may include rotating the first gas burner head when the first idler gear may be in the engaged position. In various embodiments, the method may include rotating the second gas burner head when the second idler gear may be in the engaged position.

In addition, in some embodiments, the method may include positioning both the first idler gear and the second idler gear in the engaged position. In various embodiments, the method may include positioning the first idler gear in the engaged position and the second idler gear in the disengaged position. In some embodiments, at least one drive gear may be driven by a single motor. In various embodiments, the first gas burner head may include a third burner, wherein the first burner may rotate about the first central axis in a first rotational direction, and wherein the third burner may rotate about a third central axis in a second rotational direction. Moreover, in some embodiments, the first rotational direction may be the same rotational direction as the second rotational direction. In various embodiments, the first rotational direction may be different from the second rotational direction. In some embodiments, the first central axis may be coaxially aligned with the third central axis. In some embodiments, the method of rotating the first gas burner head includes rotating the first burner at least one of faster, slower, or the same speed as rotating the third burner. In addition, in various embodiments, the method of rotating the first gas burner head includes rotating the first burner at least one of faster, slower, or the same speed as the rotation of the second burner of the step of rotating the second gas burner head.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
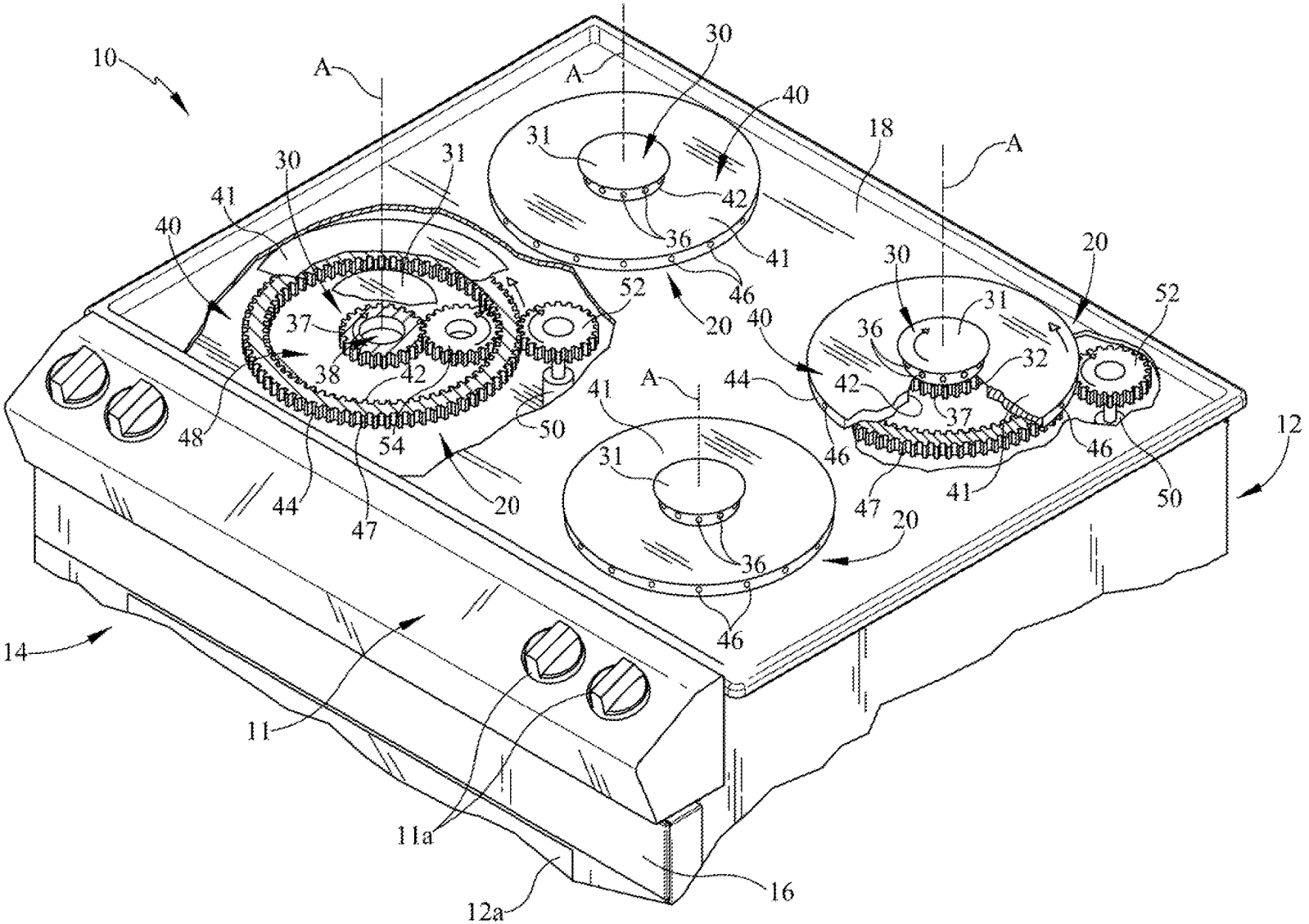
FIG. 1 is a perspective view of one embodiment of a gas burner head with portions broken away and one embodiment of an appliance with portions of the cooking surface and housing broken away.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques and apparatuses within a residential cooking appliance such as cooking appliance 10, such as the type that may be used in single-family or multi-family dwellings, or in other similar applications. However, it will be appreciated that the herein-described techniques and apparatuses may also be used in connection with other types of cooking appliances in some embodiments. For example, the herein-described techniques may be used in commercial applications in some embodiments. Moreover, the herein-described techniques may be used in connection with various cooking appliance configurations. Implementation of the herein-described techniques within gas top burner(s), oven burner, broil burner, gas range, slide-in oven, freestanding oven, gas cooktop, gas countertop range, etc. using a rotating gas burner head would be well within the abilities of one of ordinary skill in the art having the benefit of the instant disclosure, so the embodiments are not limited to the slide-in oven implementation discussed further herein.

As shown in the Figures, a home cooking appliance 10, such as but not limited to a slide-in cooking range, has a housing 12 and a cooking compartment 14, such as a baking oven, convection oven, steam oven, warming drawer and the like, in the housing 12 and accessible through a door or drawer 16 in the front 12*a* of the housing 12. In the embodiment shown, the appliance 10 is a gas range, with at least one gas burner head 20 being rotatable about a central axis A. The gas burner head may include one or more rotatable burners 30, 40 rotating about the central axis A. The appliance 10 includes a cooktop surface 18 on a top of the housing 12. The cooktop surface 18 can include one or lore cooking grates not shown) thereon. The cooking grate may support a cooking vessel or cookware (not shown) over one or more gas burner heads 20. The appliance 10 may include a control panel 11 having a plurality of control knobs or controls 11*a* for controlling the gas burner heads 20, gas burner characteristics (e.g. burner(s) rotational direction (clockwise and/or counterclockwise), speed of rotation of one or more gas burner heads and or burners within, degree of rotation, continuous rotation, and/or intermittent rotation in one or more directions, idler gears, motor, selection of gas burner head and/or burner portions to rotate or non-rotate, etc. and/or cooking compartment 14.

The one or more rotating gas burner heads 20 may include one or more rotating burners 30, 40. However, in some embodiments, a rotating gas burner head may include one rotating burner by itself, or one or more rotating burners in combination with one or more fixed or stationary burners. As shown in one embodiment in FIGS. 1-5 the gas burner head 20 may include a rotating inner or first burner 30 in combination with a rotating outer or second burner 40. In some embodiments, additional rotating rings or burners (e.g. coaxial) may be included. In some embodiments, one or more fixed or stationary burners may be included at a variety of positions relative to the first and second burners 30, 40 (e.g. at a larger annular position, between the two rotating burners, and/or centrally located, etc.). The second burner 40, or one or more portions thereof, may surround, be stacked, and/or be positioned outside of the periphery of the first burner 30. Although, the first burner 30 and second burner 40 may be coaxially aligned as shown, the axis of the one or more burners do not have to be coaxial. As shown in the one embodiment, each of the first and/or second burners 30, 40 may rotate about the central axis A. In some embodiments, the first and second burners may rotate about different axis. The first burner 30 may be substantially circular in shape and include an outer periphery 32. In some embodiments, the first burner 30 may be a variety of shapes (e.g. annular in shape). The second burner 40, outside and/or below the first burner 30, may include an inner periphery 42 and an outer periphery 44. The second burner may be substantially annular in shape. The one or more burners may be a variety of shapes including, but is not limited to, round, annular, oval, multi-lobe, concentric, and/or eccentric shaped. The first burner 30 may be positioned within the second burner inner periphery 42. For example, the second burner 40 may surround the outer periphery 32 of the first burner 30. The first burner 30 may include one or more first burner ports 36. The second burner 40 may include one or more second burner ports 46. Although the burner ports are shown to be positioned at their respective outer periphery of the burner, the burner ports may be in a variety of positions, etc. (e.g. on the top surface with radial spaced ports in linear pattern, increase or decrease in density on the top surface of the burner towards the outer periphery, circumferential or spiral pattern on the top surface of the burner). One or more gas flow channels, in fluid communication with the gas supply (not shown), may be upstream from and in fluid communication with the first burner ports 36 and/or second burner ports 46. As shown in the embodiments, the first burner ports 36 may be in fluid communication with a first gas flow channel 38 and the second burner ports 46 may be in fluid communication with a second gas flow channel 48. The one or more gas flow channels may be defined by a variety of structures (e.g. gear mechanism, one or more burners, injector cup, and/or cap, etc.). One or more gas valves (not shown) may be used to control the amount of gas flow provided to the gas burner head 20 and/or one or more burners 30, 40 from the gas supply. The user may control the amount of gas supply to the burner ports by adjusting the valve. One or more burner caps 31, 41 may be disposed over one or more burners 30, 40 and may rotate as well in some embodiments. (e.g. with or without their respective burner). However, the one or more burner caps 31, 41 may be rotationally fixed or stationary in some embodiments. Although the gas burner head 20, first and/or second burner, drive/gear mechanism, burner ports, appliance, etc. is shown in detail in the drawings, it is merely representative of one embodiment, and it is to be understood that there are a variety of shapes, sizes, orientations, constructions, and quantities which may be used and still be within the scope of the teachings herein. Further, a variety of mechanisms may be used to translate, rotate, and/or oscillate the one or more burners.

Figure 2:
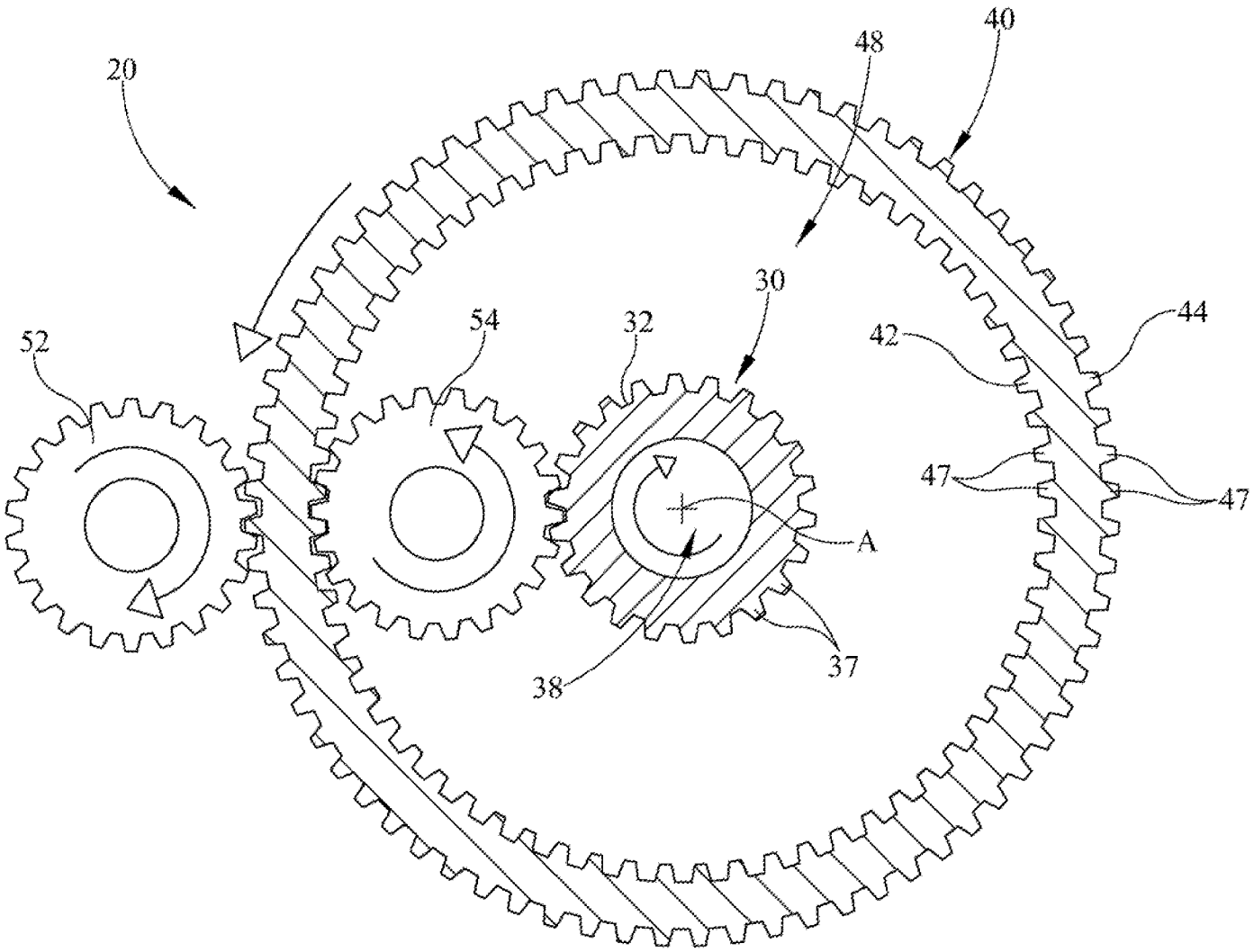
FIG. 2 is a top view of one embodiment of a gear mechanism of a rotating gas burner head of FIG. 1 illustrating an inner or first burner rotating in an opposite rotational direction from an outer or second burner.
Figure 3:
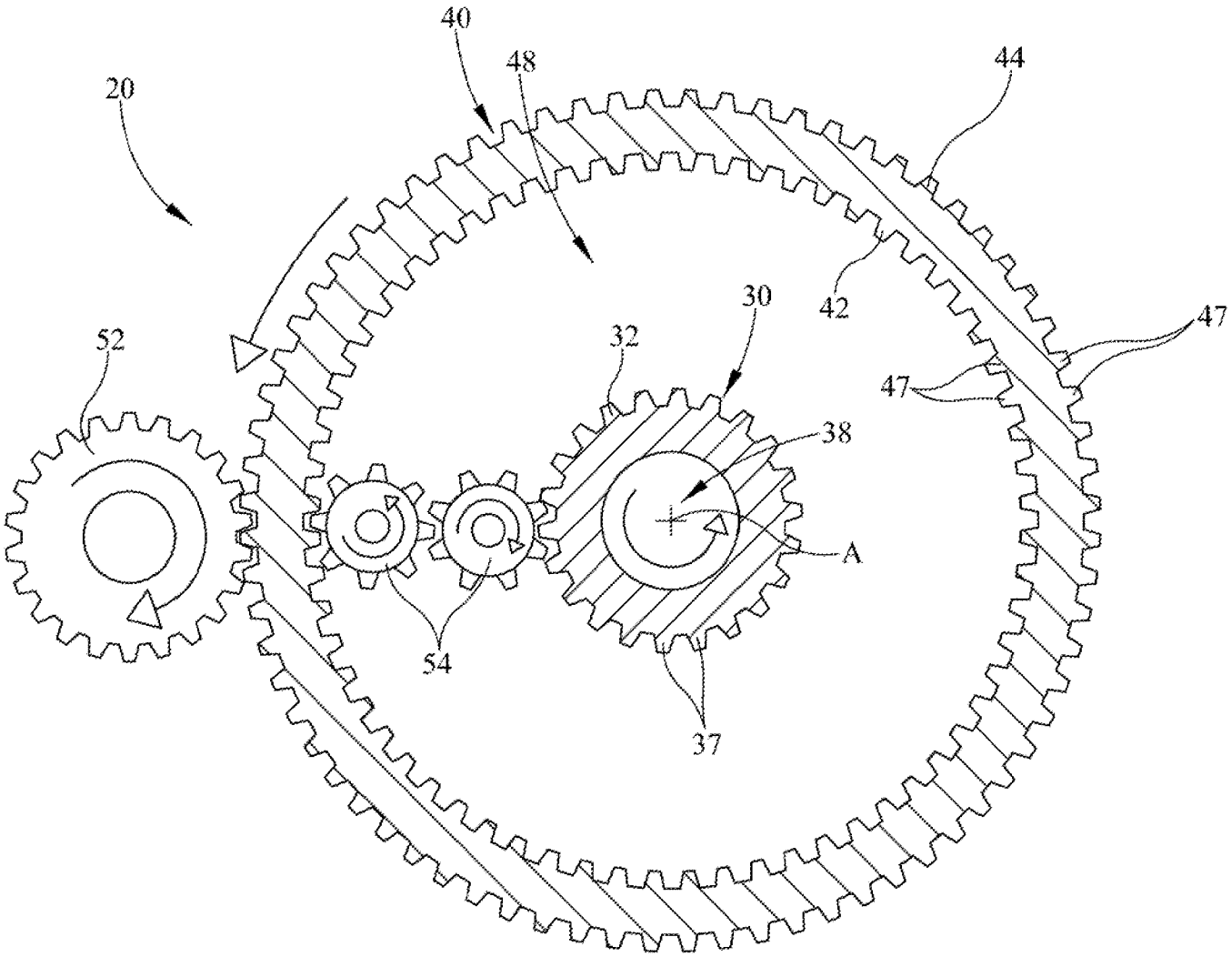
FIG. 3 is a top view of another embodiment of a gear mechanism for a rotating gas burner head illustrating an inner or first burner rotating in the same rotational direction from an outer or second burner.

At least one gas burner head 20 may include the first burner 30, second burner 40, and/or more burners rotating about one or more axis. As shown in the one embodiment, the first and second burners 30, 40 may rotate about the same central axis A. However, the burners may not be concentric in some embodiments. In various embodiments, each burner may rotate about an axis that may be different from each other. In some embodiments, the rotational axis of one or more burners may move, may not be stationary (e.g. the axis of one or more burners may move in a variety of patterns), and/or be orientated other than vertically as shown. The first burner 30 may rotate in a first rotational direction. The second burner 40 may rotate in a second rotational direction. In some embodiments, the first and/second burners 30, 40 may be able to rotate in both a first rotational direction and an opposing second rotational direction. For example, the motor may reverse directions in various embodiments. The first rotational direction may be the same or different than the second rotational direction. As shown in the embodiments of FIGS. 1 and 2, the first rotational direction of the first burner 30 may be clockwise and the second rotational direction of the second burner 40 may be counterclockwise (e.g. opposite or different rotational directions). In some embodiments, the first rotational direction of the first burner 30 may be counterclockwise and the second rotational direction of the second burner 40 may be clockwise. In other embodiments as shown in FIG. 3, the first rotational direction of the first burner 30 may be counterclockwise and the second rotational direction of the second burner 40 may be counterclockwise (e.g. the same rotational direction). It is understood that each burner may both rotate in the clockwise direction in various embodiments. Although it is shown in the embodiments of FIGS. 1-3 that the first and second burners 30, 40 rotate at the same time and speed, the first and second burners do not have to rotate at the same time and/or at the same rate or speed. For example, in some embodiments one or more burners may rotate while one or more burners are not rotating, or fixed. In some embodiments, the intermediate and/or drive gears could be disengaged from one or more burners to selectively drive or not drive rotation of one or more burners. The rotational speed of the first burner 30 may be the same or different (e.g. faster or slower) than the rotational speed of the second burner 40. For example, varying the size and/or quantity of interconnecting gears may change the rotational direction and/or speed of rotation of one or more burners and/or gas burner heads. Cams and/or ratcheting mechanisms may be used for intermittent or variable rotation of one or more burners. The rotational velocity may be varied with the gas flow and/or motor in some embodiments. With the one or more burners rotating, the flame exiting the one or more burner ports may allow a more uniform or even heating, pattern of flame movement (e.g. annular or arcuate pattern at one or more radius), and or increase the aesthetic appearance to the user.

The one or more burner heads may include a plurality of gear teeth and a variety of gear mechanisms to allow rotation of one or more burners. One or more burners 30, 40 and/or one or more gas burner heads 20 may be rotated by one or more motors 50. As is shown in the embodiments, a drive mechanism (e.g. motor) rotates each of the first burner 30 and/or the second burner 40. The motor 50 may be electric in some embodiments. The motor 50 may drive at least one burner 30, 40 in one or more rotational directions (e.g. user selected and/or preset pattern). In the embodiment shown in FIGS. 1-3, the motor 50 drives both burners 30 and 40. The motor 50 may include at least one drive car driving gear 52. The drive gear 52 may directly drive the gears of one or more burners or may indirectly drive the one or more burners via one or more driven or intermediate gears, burner gear teeth, and/or idler gears. The gears may be of any suitable type (e.g. beveled). However, each burner may be driven by a different motor in some embodiments. The motor driving axis of the shaft may be vertically orientated to engage vertical gear teeth of the one or more burners as shown, however the gear may operably engage the bottom side or bottom gear teeth (not shown) of the one or more burners in some embodiments with a horizontally orientated motor and/or shaft. The one or more rotational movement of the one or more burners may be continuous or intermittent. Moreover, in some embodiments, the one or more rotating burners may include bearings, ball transfers, sliding surfaces to allow rotational movement of the one or more burners. Although gears are used to rotate the one or more burners, it should be understood that chains, belts, capstan, cams, or other methods may be used and be still within the scope of the invention. For example, a free spinning burner may be driven by compressed air or with energy of the gas/air mixture flowing through the burner and/or burner ports in some embodiments.

As shown in FIGS. 1-3, the one or more burners 30, 40 of at least one gas burner head 20 may be each driven by a corresponding motor 50 and at least one drive gear 52. As shown, the drive gear 52 engages the outer gear teeth 47 on the outer periphery 44 of the second burner 40. It should be understood, in some embodiments, the drive gear 52 may engage the inner periphery 42 of the second burner 40 and/or one or more intermediate/idler gears. In other embodiments, the drive gear 52 may directly engage the first and second burner 30, 40. Moreover, the drive gear 52 may engage the first burner 30 and indirectly engage the second burner 40. It should be understood that the drive mechanism may be a variety of constructions, quantities, sizes, shapes, etc. and still be within the scope of the present invention.

In some embodiments, at least one gas burner head 20 with the first burner 30 and second burner 40 may rotate in the same rotational direction (e.g. clockwise and/or counterclockwise). As illustrated in FIGS. 1-2, the gear teeth of the drive gear 52 engage the plurality of gear teeth 47 on the outer periphery 44 of the second burner 40. The teeth 47 on the inner periphery 42 of the second burner 40 engage an intermediate gear 54. The intermediate gear 54 engages the plurality of gear teeth 37 on the outer periphery 32 of the first burner 30.

Moreover, in various embodiments, at least one gas burner head 20 with the first burner 30 and second burner 40 may rotate in opposite rotational directions (e.g. one burner clockwise and the other burner counterclockwise). As illustrated in FIG. 3, the gear teeth of the drive gear 52 engage the plurality of gear teeth 47 on the outer periphery 44 of the second burner 40. The gear teeth 47 on the inner periphery 42 of the second burner 40 engage two intermediate gears 54 to reverse the rotational direction of the first burner 40 from the direction of the second burner 40 is turning. The intermediate gears 54 engage or transfer rotation to the plurality of gear teeth 37 on the outer periphery 32 of the first burner 30.

Figure 4:
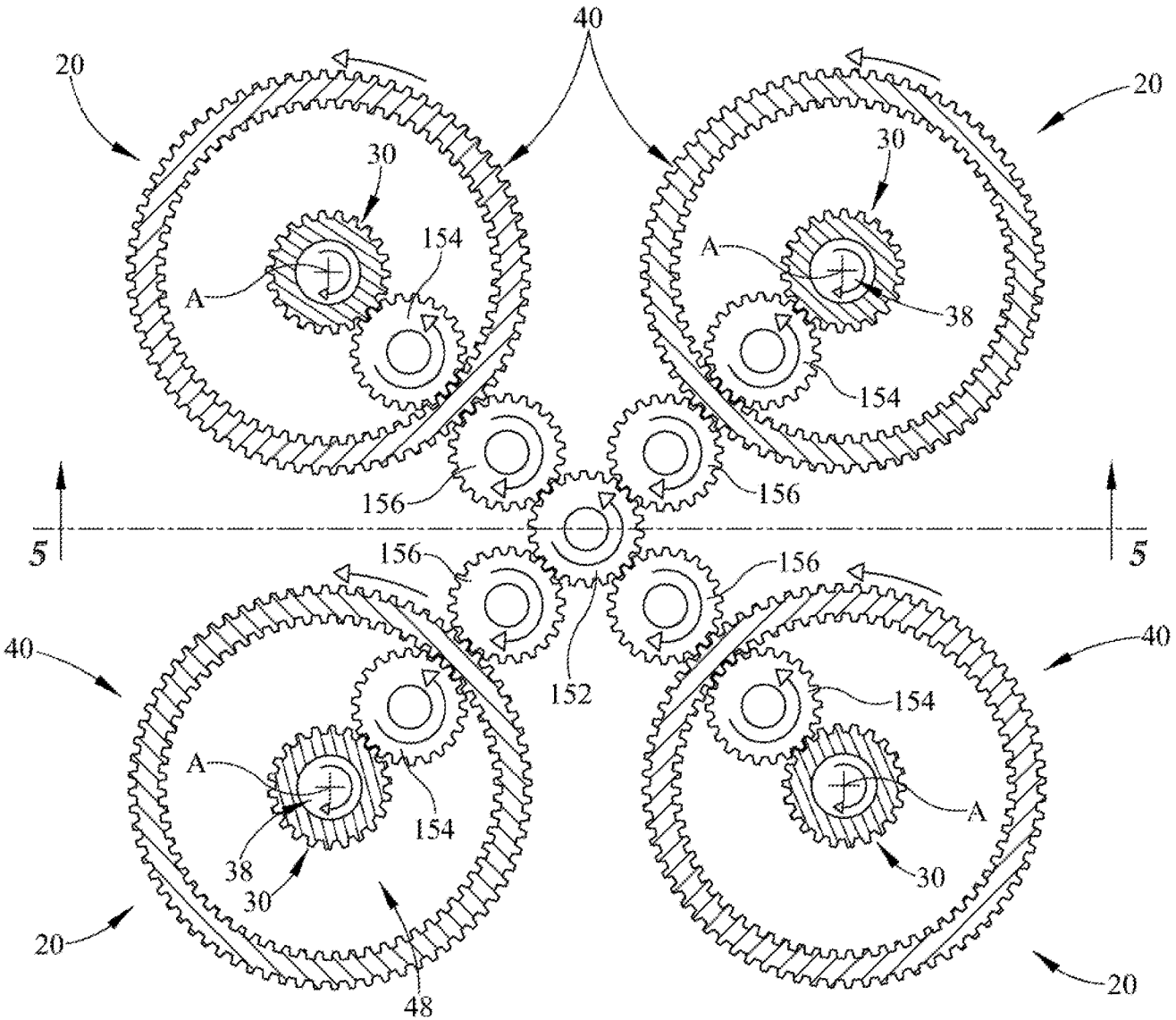
FIG. 4 is a top view of one embodiment of a gear mechanism for a plurality of rotating gas burner heads.
Figure 5:
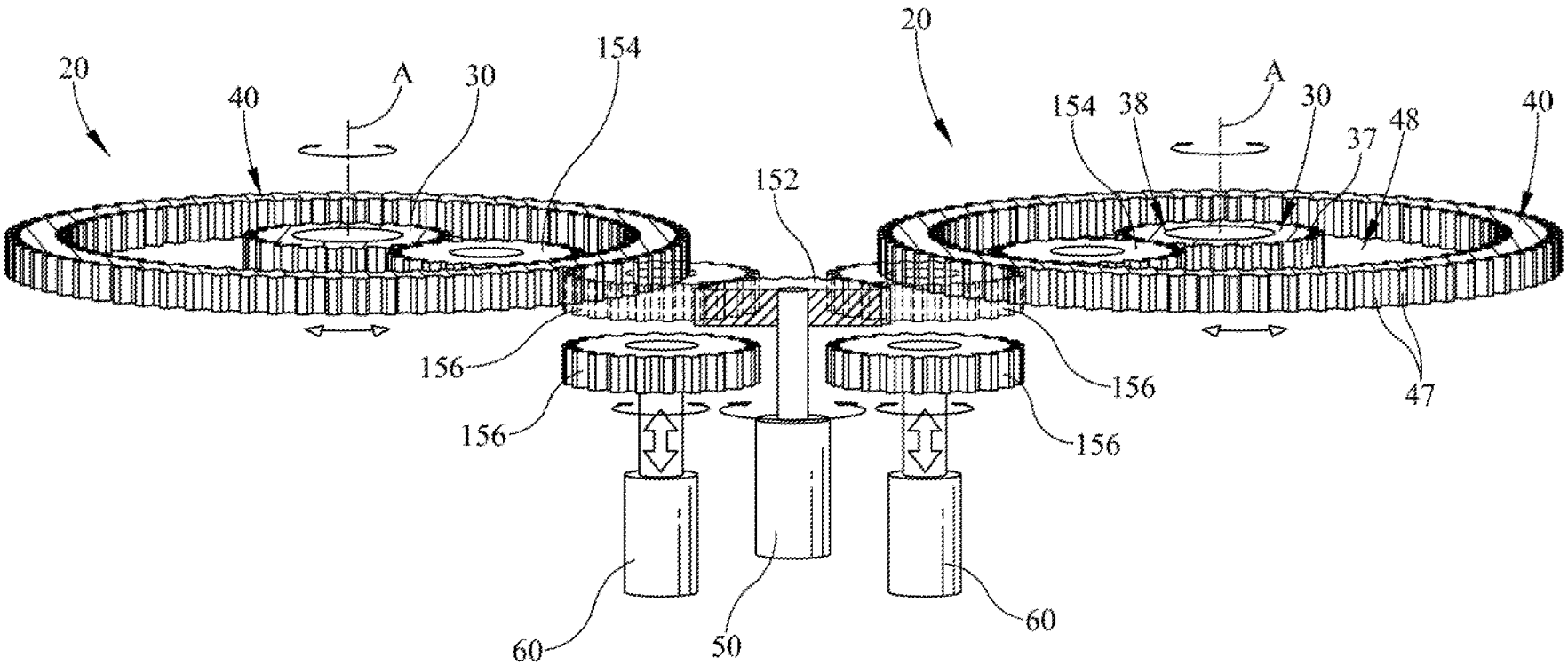
FIG. 5 is a top perspective view of the gear mechanism for a plurality of rotating gas burner heads taken along line 5-5 of FIG. 4.

As shown in FIGS. 4 and 5, embodiments of two or more rotating gas burner heads 20 may be geared together or interconnected by a variety of gear mechanisms to rotate one or more burners within each gas burner head 20. As illustrated, a single motor 150 and one or more drive gears 152, intermediate gears 154, and/or idler gears 156 may rotate at least one burner 30, 40 in two or more gas burner heads 20. Although more than one motor 50 is contemplated in some embodiments to interconnect and drive two or more gas burner heads 20, the drive gear 152 may be located to operate a plurality of gas burner heads 20 and move corresponding intermediate/idler gears 154, 156 to selectively engage the one or more rotating burners 30, 40. Although each gas burner head 20 may be shown as including two rotating burners 30, 40, the gas burner head 20 may have any number of rotating gas burners, rings, sections, etc. (e.g. one, two, three, four, and/or in combination with one or more stationary burners). In some embodiments, rotating gas burner heads may be used with other stationary gas burner heads in a variety of apparatus/appliances. Moreover, the gas burner heads 20 or one or more rotating burners 30, 40 of each gas burner head 20 may not rotate in the same direction and/or same speed as shown in FIGS. 4 and 5. For example, the rotation of one of more burners 30, 40 within one or more gas burner heads 20 may be in a variety of rotational directions (e.g. same or different), speed, continuous, intermittent, etc.

As shown more clearly in FIG. 5, the motor 50 does not have to continuously rotate one or more gas burner heads or the one or more gas burner heads 20 or portions thereof may be selected when to rotate. One or more solenoids 60 may position one or more idler gears 156 into or out of engagement with the drive gear 152, geared burner 30, 40, and/or intermediate gear 154. When the idler gear 156 is in the engaged position (shown in broken lines in FIG. 5), the idler gear 156 engages the drive gear 152 and the plurality of gear teeth 37, 47 of the gas burner head 20 or burner 30, 40. When the idler gear 156 is disengaged (shown in solid lines in FIG. 5), the idler gear 156 is disengaged from at least one of the drive gear 152, burner 30, 40, and/or intermediate gears 154. The user may control various parameters of the one or more gas burner heads 20, or one or more rotating burners 30, 40 therein. For example, the rotational direction of a burner (e.g. clockwise and/or counterclockwise), the speed of the burner, continuous and/or intermittent movement of the burner, rotation or nonrotation of a rotating burner, selection of one or more gas burner heads 20 to rotate, etc. For example, the motor 50 may change direction of rotation and speed of rotation, etc. It should be understood that a variety of one or more intermediate gears 154, clutch mechanisms, and/or idler gears 156 may be used to accomplish a variety of characteristics of the one or more gas burner heads. For example, turning an inner burner without turning the outer burner. Moreover, for example, rotating one gas burner head 20 in one direction and another gas burner head 20 in an opposing direction.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or", as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than. A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms"connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A gas range appliance comprising:

a first gas burner head having at least a first burner with a plurality of first burner ports, wherein the plurality of first burner ports are in fluid communication with one or more upstream gas flow channels, and wherein the first gas burner head includes a first plurality of gear teeth and rotates about a first central axis;

a second gas burner head having at least a second burner with a plurality of second burner ports, wherein the plurality of first burner ports are in fluid communication with one or more upstream gas flow channels, and wherein the second gas burner head includes a second plurality of gear teeth and rotates about a second central axis;

at least one drive gear;

a first idler gear positionable in an engaged position and a disengaged position, wherein when in the engaged position the first idler gear engages the at least one drive gear with the first plurality of gear teeth of the first gas burner head and when in the disengaged position the first idler gear disengages the at least one drive gear from the first plurality of gear teeth of the first gas burner head;

a second idler gear positionable in an engaged position and a disengaged position, wherein when in the engaged position the second idler gear engages the at least one drive gear with the second plurality of gear teeth of the second gas burner head and when in the disengaged position the second idler gear disengages the at least one drive gear from the second plurality of gear teeth of the second gas burner head; and a first solenoid positioning the first idler gear in at least one of the engaged position and the disengaged position.

2. The gas range appliance of claim 1 further comprising a motor rotating the at least one drive gear.

3. The gas range appliance of claim 2 further comprising a single one of the motor.

4. The gas range appliance of claim 1 further comprising a second solenoid positioning the second idler gear in at least one of the engaged position and the disengaged position.

5. The gas range appliance of claim 1 wherein the first idler gear is in the engaged position and the second idler gear is in the disengaged position.

6. The gas range appliance of claim 1 wherein the first idler gear is in the disengaged position and the second idler gear is in the disengaged position.

7. The gas range appliance of claim 1 wherein the first gas burner head includes a third burner, wherein the first burner rotates about the first central axis in a first rotational direction, and wherein the third burner rotates about a third central axis in a second rotational direction.

8. The gas range appliance of claim 7 wherein the first rotational direction is different from the second rotational direction.

9. The gas range appliance of claim 7 wherein the first central axis is coaxially aligned with the third central axis.

10. A gas range comprising:

a first gas burner head having at least a first burner with a plurality of first burner ports, wherein the plurality of first burner ports are in fluid communication with one or more upstream gas flow channels, and wherein the first gas burner head includes a first plurality of gear teeth and rotates about a first central axis;

a second gas burner head having at least a second burner with a plurality of second burner ports, wherein the plurality of first burner ports are in fluid communication with one or more upstream gas flow channels, and wherein the second gas burner head includes a second plurality of gear teeth and rotates about a second central axis;

a single motor and at least one drive gear;

a first idler gear positionable in an engaged position and a disengaged position, wherein when in the engaged position the first idler gear engages the at least one drive gear with the first plurality of gear teeth of the first gas burner head and when in the disengaged position the first idler gear disengages the at least one drive gear from the first plurality of gear teeth of the first gas burner head;

a second idler gear positionable in an engaged position and a disengaged position, wherein when in the engaged position the second idler gear engages the at least one drive gear with the second plurality of gear teeth of the second gas burner head and when in the disengaged position the second idler gear disengages the at least one drive gear from the second plurality of gear teeth of the second gas burner head; and wherein the first gas burner head includes a third burner, wherein the first burner rotates about the first central axis in a first rotational direction, and wherein the third burner rotates about a third central axis in a second rotational direction.

11. The gas range of claim 10 further in combination with an appliance.

12. The gas range of claim 10 wherein the first central axis is coaxially aligned with the third central axis.

13. The gas range of claim 10 wherein the first rotational direction is different from the second rotational direction.

14. A method of distributing heat from a gas range comprising the steps of:

providing a first gas burner head having at least a first burner with plurality of first burner ports, wherein the plurality of first burner ports are in fluid communication with one or more upstream gas flow channels, and wherein the first gas burner head includes a first plurality of gear teeth and rotates about a first central axis;

providing a second gas burner head having at least a second burner with a plurality of second burner ports, wherein the plurality of first burner ports are in fluid communication with one or more upstream gas flow channels, and wherein the second gas burner head includes a second plurality of gear teeth and rotates about a second central axis;

providing at least one drive gear;

positioning a first idler gear between an engaged position and a disengaged position, wherein when in the engaged position the first idler gear engages the at least one drive gear with the first plurality of gear teeth of the first gas burner head and when in the disengaged position the first idler gear disengages the at least one drive gear from the first plurality of gear teeth of the first gas burner head;

positioning a second idler gear between an engaged position and a disengaged position, wherein when in the engaged position the second idler gear engages the at least one drive gear with the second plurality of gear teeth of the second gas burner head and when in the disengaged position the second idler gear disengages the at least one drive gear from the second plurality of gear teeth of the second gas burner head;

rotating the first gas burner head when the first idler gear is in the engaged position;

rotating the second gas burner head when the second idler gear is in the engaged position; and wherein the first gas burner head includes a third burner, wherein the first burner rotates about the first central axis in a first rotational direction, and wherein the third burner rotates about a third central axis in a second rotational direction.

15. The method of claim 14 further comprising the step of positioning both the first idler gear and the second idler gear in the engaged position.

16. The method of claim 14 further comprising the step of positioning the first idler gear in the engaged position and the second idler gear in the disengaged position.

17. The method of claim 14 wherein the at least one drive gear is driven by a single motor.

18. The method of claim 14 wherein the first rotational direction is the same rotational direction as the second rotational direction.

19. The method of claim 14 wherein the first rotational direction is different from the second rotational direction.

20. The method of claim 14 wherein the first central axis is coaxially aligned with the third central axis.

21. The method of claim 14 wherein the step of rotating the first gas burner head includes rotating the first burner at least one of faster, slower, or the same speed as rotating the third burner.

22. The method of claim 14 wherein the step of rotating the first gas burner head includes rotating the first burner at least one of faster, slower, or the same speed as the rotation of the second burner of the step of rotating the second gas burner head.

23. A gas range appliance comprising:

a first gas burner head having at least a first burner with a plurality of first burner ports, wherein the plurality of first burner ports are in fluid communication with one or more upstream gas flow channels, and wherein the first gas burner head includes a first plurality of gear teeth and rotates about a first central axis;

a second gas burner head having at least a second burner with a plurality of second burner ports, wherein the plurality of first burner ports are in fluid communication with one or more upstream gas flow channels, and wherein the second gas burner head includes a second plurality of gear teeth and rotates about a second central axis;

at least one drive gear;

a first idler gear positionable in an engaged position and a disengaged position, wherein when in the engaged position the first idler gear engages the at least one drive gear with the first plurality of gear teeth of the first gas burner head and when in the disengaged position the first idler gear disengages the at least one drive gear from the first plurality of gear teeth of the first gas burner head;

a second idler gear positionable in an engaged position and a disengaged position, wherein when in the engaged position the second idler gear engages the at least one drive gear with the second plurality of gear teeth of the second gas burner head and when in the disengaged position the second idler gear disengages the at least one drive gear from the second plurality of gear teeth of the second gas burner head; and wherein the first gas burner head includes a third burner, wherein the first burner rotates about the first central axis in a first rotational direction, and wherein the third burner rotates about a third central axis in a second rotational direction.

24. The gas range appliance of claim 23 wherein the first rotational direction is different from the second rotational direction.

25. The gas range appliance of claim 23 wherein the first central axis is coaxially aligned with the third central axis.

26. The gas range appliance of claim 23 further comprising a motor rotating the at least one drive gear.

27. The gas range appliance of claim 26 further comprising a single one of the motor.

28. The gas range appliance of claim 23 further comprising a first solenoid positioning the first idler gear in at least one of the engaged position and the disengaged position and a second solenoid positioning the second idler gear in at least one of the engaged position and the disengaged position.

29. The gas range appliance of claim 23 wherein the first idler gear is in the engaged position and the second idler gear is in the disengaged position.

30. The gas range appliance of claim 23 wherein the first idler gear is in the disengaged position and the second idler gear is in the disengaged position.

* * * * *